US011383538B2

(12) United States Patent
Kondo

(10) Patent No.: US 11,383,538 B2
(45) Date of Patent: Jul. 12, 2022

(54) SHEET CONVEYING DEVICE AND INKJET RECORDING APPARATUS

(71) Applicant: KYOCERA Document Solutions Inc., Osaka (JP)

(72) Inventor: Kazuhisa Kondo, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 106 days.

(21) Appl. No.: 17/070,017

(22) Filed: Oct. 14, 2020

(65) Prior Publication Data

US 2021/0107305 A1 Apr. 15, 2021

(30) Foreign Application Priority Data

Oct. 15, 2019 (JP) ..... JP2019-188415

(51) Int. Cl.

| | |
|---|---|
| ***B65H 5/06*** | (2006.01) |
| ***B65H 29/12*** | (2006.01) |
| ***B41J 13/076*** | (2006.01) |
| ***B41J 13/03*** | (2006.01) |

(52) U.S. Cl.

CPC ..... *B41J 13/076* (2013.01); *B41J 13/03* (2013.01); *B65H 5/062* (2013.01); *B65H 2404/1316* (2013.01); *B65H 2404/1415* (2013.01); *B65H 2801/06* (2013.01)

(58) Field of Classification Search

CPC ..... B65H 29/12; B65H 29/125; B65H 29/70; B65H 5/062; B65H 2404/1316; B65H 2404/1415; B65H 2404/1414; B65H 2404/1431; B65H 2404/144; B65H 2404/1115; B41J 13/076; B41J 13/03; B41J 13/02

See application file for complete search history.

(56) References Cited

U.S. PATENT DOCUMENTS 5,961,234 A * 10/1999 Uchikata ..... B65H 27/00 400/636
7,661,674 B2 * 2/2010 Izuchi ..... B65H 29/70 271/274

FOREIGN PATENT DOCUMENTS

EP 2251286 A2 * 11/2010 ..... B65H 3/0653
JP 2004-291309 10/2004

* cited by examiner

*Primary Examiner* — Luis A Gonzalez
(74) *Attorney, Agent, or Firm* — Lex IP Meister, PLLC

(57) ABSTRACT

A sheet conveying device includes a conveying roller configured to convey a sheet and a plurality of driven rotating units. The conveying roller includes a plurality of roller portions disposed at positions opposite to the driven rotating units. Each of the roller portions has three or more annular grooves arranged side by side. Each of the driven rotating units includes three or more driven rotating bodies that are disposed at positions opposite to the annular grooves, respectively. A plurality of convex portions and a plurality of concave portions are alternately provided on an outer edge of each of the driven rotating bodies. The driven rotating bodies include two first rotating bodies positioned at both ends and one or more second rotating bodies located between the first rotating bodies and having an outer diameter smaller than the outer diameter of the first rotating bodies.

4 Claims, 5 Drawing Sheets

SHEET CONVEYING DEVICE AND INKJET RECORDING APPARATUS

INCORPORATION BY REFERENCE

This application is based upon and claims the benefit of priority from the corresponding Japanese Patent Application No. 2019-188415 filed on Oct. 15, 2019, the entire contents of which are incorporated herein by reference.

BACKGROUND

The present disclosure relates to a sheet conveying device that conveys a sheet downstream of an inkjet unit and an inkjet recording apparatus including the same.

The inkjet recording apparatus includes an inkjet unit that forms an image on a sheet by discharging ink. The sheet conveying device disposed downstream in the sheet conveying direction with respect to the inkjet unit may convey the sheet, on which an ink image that has not been sufficiently dried is formed, further downstream.

In addition, in the inkjet recording apparatus, it is known that the sheet conveying device includes a conveying roller and a plurality of rowel-shaped driven rotating bodies.

The rowel-shaped driven rotating body has a plurality of convex portions and a plurality of concave portions alternately arranged along an entire circumference of an outer edge. The plurality of convex portions are in contact with a surface of the sheet on which the ink image is formed. Thus, the driven rotating body is driven to rotate with respect to the movement of the sheet.

Since the rowel-shaped driven rotating body has a small area of contact with the sheet, the rowel-shaped driven rotating body is less likely to adversely affect the ink image that is not sufficiently dried.

It is also known that the plurality of driven rotating bodies are supported by one elastic shaft in the form of a coil spring. In this case, the plurality of driven rotating bodies are urged toward the conveying roller by the elastic shaft.

SUMMARY

A sheet conveying device according to one aspect of the present disclosure includes a conveying roller configured to convey a sheet having an image formed on a first surface of the sheet by discharged ink and a plurality of driven rotating units. The conveying roller includes a first shaft supported at a position along a first direction and driven to rotate, and a plurality of roller portions that are disposed at positions opposite to the plurality of driven rotating units, respectively, are fixed to the first shaft, and rotate in contact with a second surface of the sheet opposite with the first surface to convey the sheet in a second direction orthogonal to the first direction. Each of the plurality of roller portions has three or more annular grooves. The three or more annular grooves are each provided over an entire circumference of each roller portion, and are arranged side by side in the first direction. Each of the plurality of driven rotating units includes a second shaft supported at a position along the first direction and urged toward the plurality of roller portions, and three or more driven rotating bodies disposed at positions opposite to the three or more annular grooves, respectively, and rotatably supported by the second shaft. A plurality of convex portions and a plurality of concave portions are alternately provided over an entire circumference of an outer edge of each of the three or more driven rotating bodies. Each of the three or more driven rotating bodies is driven to rotate with respect to movement of the sheet by the plurality of convex portions coming into contact with the first surface of the sheet. The three or more driven rotating bodies in each driven rotating unit include two first rotating bodies positioned at both ends in the first direction and one or more second rotating bodies located between the two first rotating bodies in the first direction and having an outer diameter smaller than the outer diameter of the two first rotating bodies.

DETAILED DESCRIPTION

Hereinafter, an embodiment of the present disclosure will be described with reference to the drawings. Note that the following embodiment is an example in which the present disclosure is embodied, and does not limit the technical scope of the present disclosure.

[Configuration of Inkjet Recording Apparatus 10]

An inkjet recording apparatus 10 according to an embodiment is a printer capable of performing a printing process by an inkjet method. The printing process is a process of forming an image on a sheet 9. The sheet 9 is a sheet-like image forming medium such as paper or a resin film.

The inkjet recording apparatus 10 may be a facsimile apparatus, a copier, a multifunction peripheral or the like capable of executing the printing process by an inkjet method.

Figure 1:
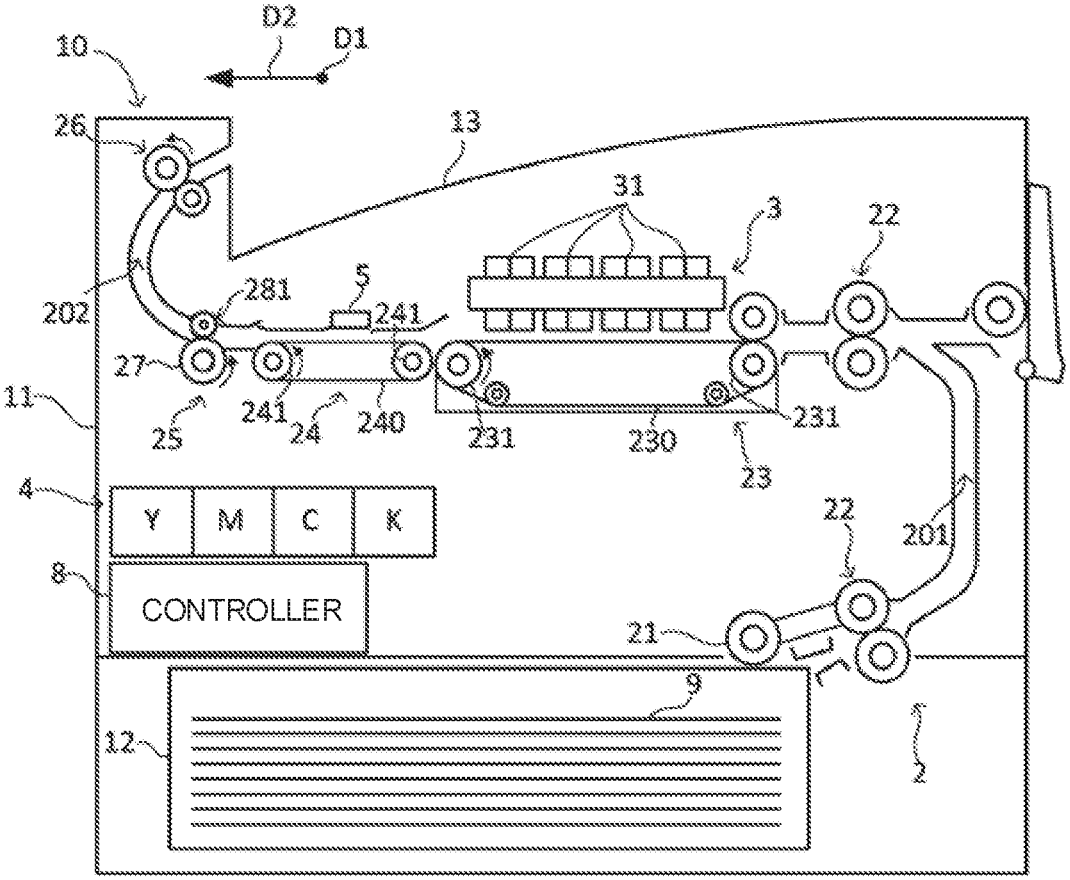
FIG. 1 is a diagram illustrating a configuration of an inkjet recording apparatus according to an embodiment.

As shown in FIG. 1, the inkjet recording apparatus 10 includes a sheet storage portion 12, a sheet conveying apparatus 2, an inkjet unit 3, an ink supply unit 4, and a controller 8. The inkjet unit 3 includes a plurality of ink heads 31.

The sheet conveying apparatus 2, the inkjet unit 3, the ink supply unit 4, and the controller 8 are housed in a housing 11 that forms a main body of the inkjet recording apparatus 10.

The sheet storage portion 12 can store a plurality of sheets 9. The sheet conveying apparatus 2 conveys the sheets 9 stored in the sheet storage portion 12 one by one along an upstream conveying path 201 and a downstream conveying path 202, and further discharges the sheets 9 from the downstream conveying path 202 to a discharge tray 13. The upstream conveying path 201 and the downstream conveying path 202 are sheet conveyance paths.

The sheet conveying apparatus 2 includes a sheet feeding portion 21, a plurality of upstream conveying roller pairs 22, a main conveying unit 23, a downstream conveying unit 24, a relay sheet conveying device 25, and a discharge roller pair 26. The sheet feeding portion 21 feeds the sheets 9 one by one from the sheet storage portion 12 to the upstream conveying path 201. The relay sheet conveying device 25 is an example of the sheet conveying device of the present disclosure.

The plurality of upstream conveying roller pairs 22 take over the conveyance of the sheet 9 from the sheet feeding portion 21 and convey the sheet 9 toward the main conveying unit 23.

The main conveying unit 23 is disposed below the inkjet unit 3. The main conveying unit 23 conveys the sheet 9 while causing the first surface of the sheet 9 to face the inkjet unit 3. The first surface of the sheet 9 is a surface on which an ink image is formed. In the following description, a surface of the sheet 9 opposite with the first surface is referred to as "second surface".

In the main conveying unit 23, a plurality of stretching rollers 231 support and rotate an endless main conveying belt 230. Thus, the main conveying unit 23 conveys the sheet 9 toward the downstream conveying unit 24 while placing the sheet 9 on the main conveying belt 230.

The inkjet unit 3 forms the ink image on the first surface of the sheet 9 by discharging inks of a plurality of colors toward the sheet 9 conveyed by the main conveying unit 23.

In the downstream conveying unit 24, a plurality of stretching rollers 241 support and rotate an endless downstream conveying belt 240. As a result, the downstream conveying unit 24 conveys the sheet 9 on which the ink image is formed toward the relay sheet conveying device 25 while placing the sheet 9 on the downstream conveying belt 240.

The inkjet recording apparatus 10 further includes a heater 5 disposed above the downstream conveying belt 240. The heater 5 dries the ink image on the sheet 9 by heating the first surface of the sheet 9 conveyed from the main conveying unit 23.

The relay sheet conveying device 25 takes over the conveyance of the sheet 9 after image formation conveyed from the downstream conveying unit 24, and conveys the sheet 9 further downstream along the downstream conveying path 202. The downstream conveying path 202 is the sheet conveyance path, which extends from the relay sheet conveying device 25 to the discharge roller pair 26.

Figure 2:
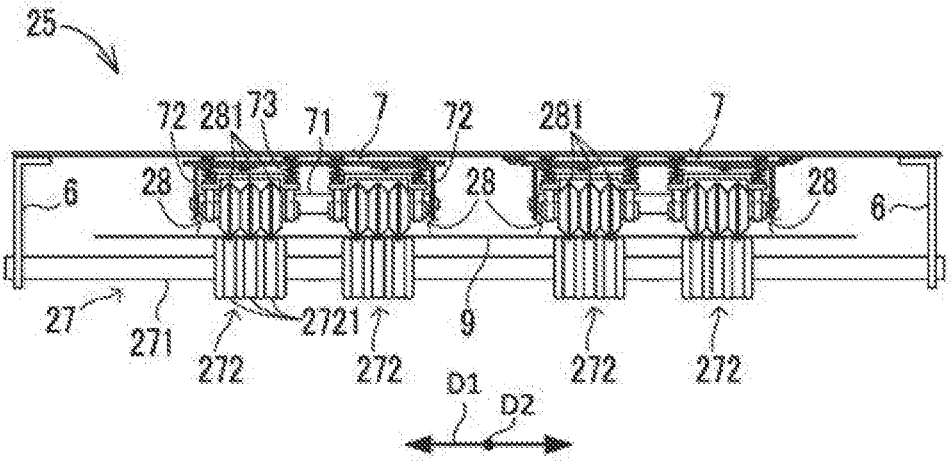
FIG. 2 is a front view of a relay sheet conveying device in the inkjet recording apparatus according to the embodiment.

As shown in FIGS. 1 and 2, the relay sheet conveying device 25 includes a conveying roller 27 and a plurality of driven rotating bodies 281. The plurality of driven rotating bodies 281 are elastically urged toward the conveying roller 27 by a spring 73.

The conveying roller 27 and the plurality of driven rotating bodies 281 convey the sheet 9, on the first surface of which an image is formed by discharging ink, by rotating while holding the sheet 9 between the conveying roller 27 and the driven rotating bodies 281.

Figure 3:
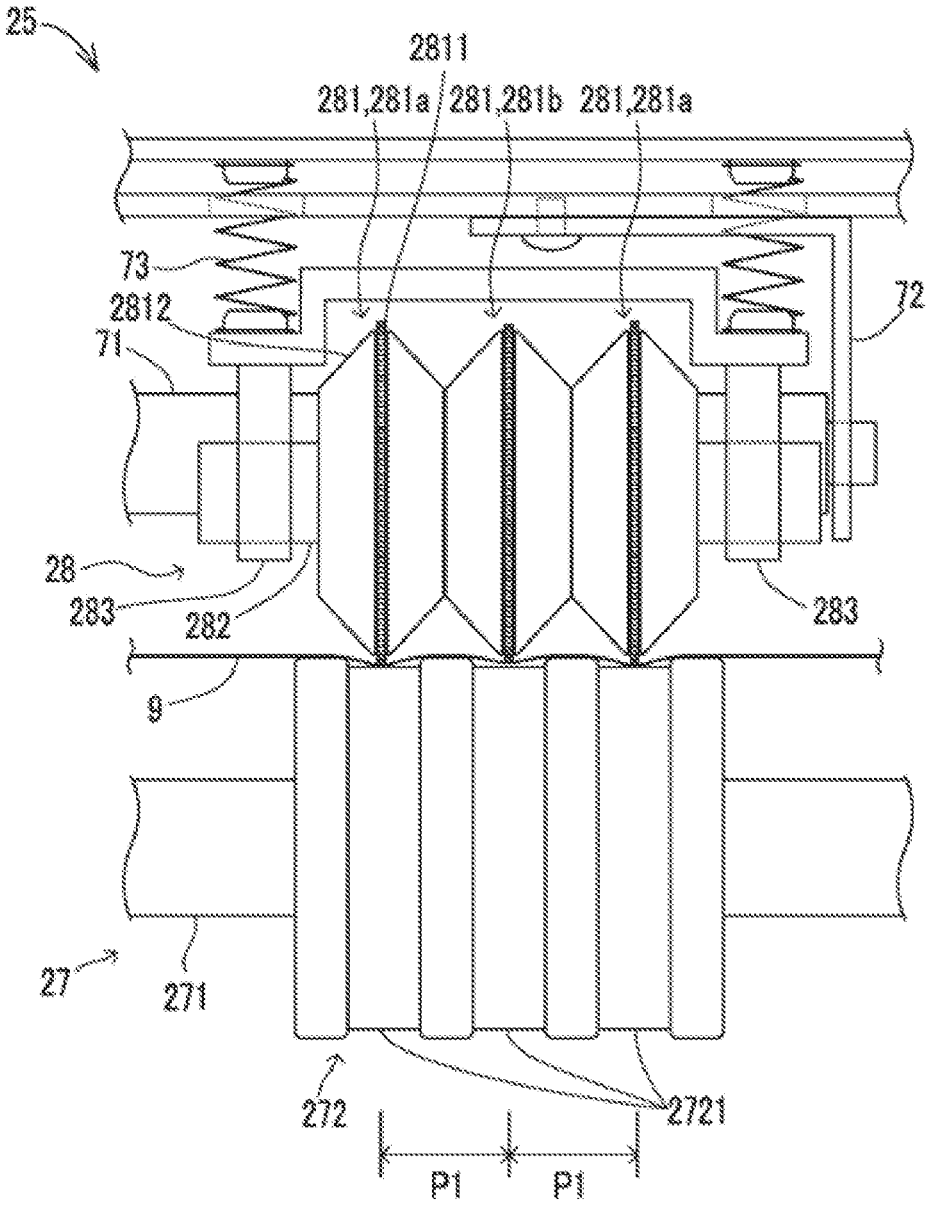
FIG. 3 is a front view of a driven rotating unit and a roller portion in the relay sheet conveying device of the inkjet recording apparatus according to the embodiment.
Figure 4:
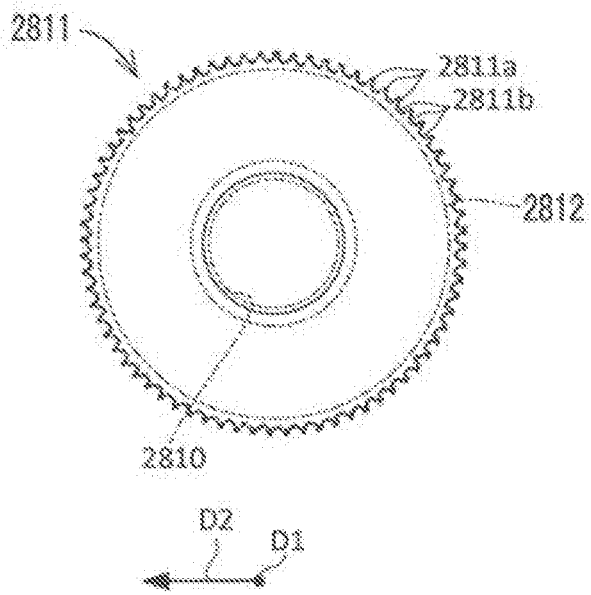
FIG. 4 is a side view of a substrate portion of a driven rotating body in the relay sheet conveying device of the inkjet recording apparatus according to the embodiment.

As shown in FIGS. 3 and 4, the driven rotating bodies 281 each include a rowel-shaped substrate portion 2811 and a molded resin portion 2812 formed integrally with the substrate portion 2811.

For example, the molded resin portion 2812 is a synthetic resin member molded by insert molding using the metal substrate portion 2811 as an insert article. It is also conceivable that the molded resin portion 2812 is integrally combined with the substrate portion 2811 after being molded.

As shown in FIG. 4, a plurality of convex portions 2811*a* and a plurality of concave portions 2811*b* are alternately arranged along the entire circumference of the outer edge of the substrate portion 2811. In FIG. 4, the molded resin portion 2812 integrated with the substrate portion 2811 is shown by an imaginary line (two-dot chain line).

The plurality of convex portions 2811*a* come into contact with the first surface of the sheet 9 on which the ink image is formed. Thus, the driven rotating bodies 281 are driven to rotate with respect to the movement of the sheet 9.

Since the rowel-shaped substrate portion 2811 of the driven rotating body 281 has a small area of contact with the sheet 9, the substrate portion 2811 is less likely to adversely affect the ink image that is not sufficiently dried.

The discharge roller pair 26 discharges the sheet 9 conveyed from the relay sheet conveying device 25 to the discharge tray 13.

The controller 8 is a device including a processor that executes various types of data processing and control. The controller 8 controls the sheet conveying apparatus 2, the inkjet unit 3, and the ink supply unit 4.

Meanwhile, when the plurality of driven rotating bodies 281 are supported by one elastic shaft, the posture of each of the driven rotating bodies 281 may be unstable and the conveyance of the sheet 9 may be unstable.

Further, when all the driven rotating bodies 281 are supported by a single shaft having high rigidity, the plurality of driven rotating bodies 281 cannot be individually displaced in accordance with the flexibility of the sheet 9, and the driven rotating bodies 281 may damage the sheet 9.

On the other hand, the plurality of driven rotating bodies 281 may be individually supported and urged by the same number of support shafts and springs as the driven rotating bodies 281. In this case, the number of components increases, and a great deal of time and effort is required to assemble the support shafts and the springs.

Since the relay sheet conveying device 25 has the structure shown in FIGS. 2 to 5, the relay sheet conveying device 25 stably conveys the sheet 9 with a relatively small number of components and with less damage to the sheet 9.

[Relay Sheet Conveying Device 25]

Hereinafter, a more specific configuration of the relay sheet conveying device 25 will be described with reference to FIGS. 2, 3, and 5.

In the following description, the longitudinal direction of the conveying roller 27 in the relay sheet conveying device 25 is referred to as "first direction D1", and the direction in which the relay sheet conveying device 25 conveys the sheet 9 is referred to as "second direction D2". The second direction D2 is a direction orthogonal to the first direction D1.

The relay sheet conveying device 25 includes the conveying roller 27 and a plurality of driven rotating units 28 that convey the sheet 9, on the first surface of which an image is formed by discharging ink. In the example shown in FIG. 2, the relay sheet conveying device 25 includes four driven rotating units 28.

Each of the driven rotating units 28 includes three or more driven rotating bodies 281. For example, the number of the driven rotating bodies 281 in each of the driven rotating units 28 is three or four. In the example shown in FIG. 2, each of the driven rotating units 28 includes three driven rotating bodies 281.

The conveying roller 27 includes a first shaft 271 and a plurality of roller portions 272. The first shaft 271 is a hard member mainly made of metal such as iron.

The first shaft 271 is present over a range including a range through which the sheet 9 passes in the first direction D1. The first shaft 271 is disposed at a position along the first direction D1, is supported by a conveying roller support portion 6, and is driven to rotate by a motor and a gear device (neither illustrated).

The plurality of roller portions 272 are disposed at positions opposite to the plurality of driven rotating units 28, respectively. The plurality of roller portions 272 are fixed to the first shaft 271. The plurality of roller portions 272 are formed integrally with the first shaft 271. In the example shown in FIG. 2, four roller portions 272 are provided to face the four driven rotating units 28.

Therefore, the conveying roller 27 includes the same number of roller portions 272 as the driven rotating units 28. In other words, the relay sheet conveying device 25 includes the same number of driven rotating units 28 as the roller portions 272.

The plurality of roller portions 272 convey the sheet 9 in the second direction D2 by rotating in contact with the second surface of the sheet 9 opposite with the first surface.

Each of the roller portions 272 is an elastic member mainly made of rubber, an elastomer resin or the like. A particle coating is applied to the outer peripheral surface of each of the roller portions 272. The particle coating is formed, for example, by spraying ceramic particles having an outer diameter of about 100 micrometers.

Each of the roller portions 272 has three or more annular grooves 2721. The annular grooves 2721 are each provided over the entire circumference of the relevant roller portion 272 and are arranged side by side in the first direction D1. Each of the roller portions 272 has the same number of annular grooves 2721 as the driven rotating bodies 281 in each of the driven rotating units 28. In the example shown in FIGS. 2 and 3, each of the roller portions 272 has three annular grooves 2721.

In the following description, the pitch in the first direction D1 of the three or more annular grooves 2721 in each of the roller portions 272 is referred to as "groove pitch P1" (see FIG. 3).

Each of the driven rotating units 28 includes the three or more driven rotating bodies 281, a second shaft 282, and a unit base 283. The second shaft 282 is a hard member mainly made of metal such as iron.

The second shaft 282 is disposed at a position along the first direction D1 and is supported by the unit base 283. The unit base 283 is a support that supports the second shaft 282. A shaft hole 2810 through which the second shaft 282 passes is formed in the center of the driven rotating bodies 281 (see FIG. 4).

The driven rotating bodies 281 are disposed at positions opposite to the annular grooves 2721, respectively. The driven rotating bodies 281 are each rotatably supported by the second shaft 282. The driven rotating bodies 281 each include the substrate portion 2811 and, accordingly, the plurality of convex portions 2811*a* and the plurality of concave portions 2811*b* alternately arranged along the entire circumference of the outer edge (see FIG. 4).

The relay sheet conveying device 25 further includes the conveying roller support portion 6 that supports the first shaft 271, and a unit support device 7 that supports the unit base 283 in a swingable manner.

The unit support device 7 includes a third shaft 71, a shaft support portion 72, and the spring 73. The third shaft 71 swingably supports the unit base 283. That is, the unit base 283 is swingable about the third shaft 71 along the direction in which the unit base 283 moves away from and toward the conveying roller 27.

The spring 73 is an elastic member that elastically urges the unit base 283 toward the conveying roller 27. That is, the spring 73 elastically urges the second shaft 282 toward the conveying roller 27 via the unit base 283. In other words, the spring 73 elastically urges the entire driven rotating unit 28 toward the conveying roller 27.

Figure 5:
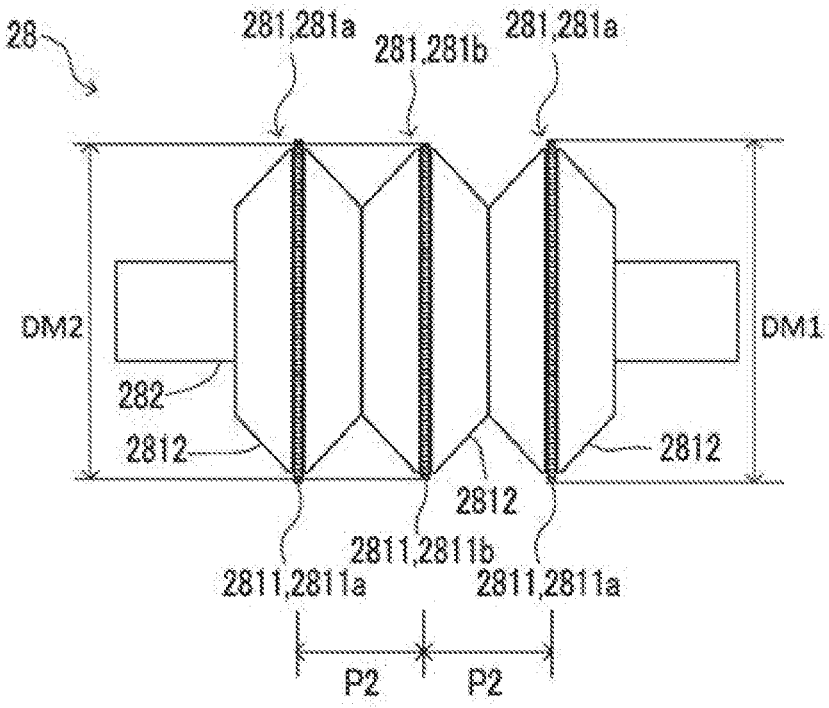
FIG. 5 is a front view of three driven rotating bodies in the relay sheet conveying device of the inkjet recording apparatus according to the embodiment.

In each of the driven rotating units 28, the three or more driven rotating bodies 281 include two first rotating bodies 281*a* located at both ends in the first direction D1 and one or more second rotating bodies 281*b* (see FIGS. 2, 3, and 5). The one or more second rotating bodies 281*b* are positioned between the two first rotating bodies 281*a* in the first direction D1.

In the example shown in FIGS. 2, 3, and 5, the number of driven rotating bodies 281 in each driven rotating unit 28 is three. Therefore, each of the driven rotating units 28 includes one second rotating body 281*b*.

If the number of the driven rotating bodies 281 in each of the driven rotating units 28 is four, the number of the second rotating bodies 281*b* in each of the driven rotating units 28 is two.

As shown in FIG. 5, a second outer diameter DM2, which is the outer diameter of the second rotating body 281*b*, is smaller than a first outer diameter DM1, which is the outer diameter of the first rotating body 281*a*.

Here, a pitch in the first direction D1 of the three or more driven rotating bodies 281 in each of the driven rotating units 28 is referred to as "rowel pitch P2" (see FIG. 5). The rowel pitch P2 is equal to the groove pitch P1. For example, the groove pitch P1 and the rowel pitch P2 are each deemed to be 5 mm to 11 mm.

In each of the driven rotating units 28, the molded resin portion 2812 serves as a spacer that maintains a constant pitch of the driven rotating bodies 281 in the first direction D1. In each of the driven rotating units 28, the three or more driven rotating bodies 281 are independently rotatable with respect to the second shaft 282.

The groove pitch P1 and the rowel pitch P2 may equally be 5 mm to 11 mm. In that case, the difference between the first outer diameter DM1 and the second outer diameter DM2 may be 3.5% to 5.5% of the rowel pitch P2.

In the relay sheet conveying device 25, one roller portion 272 and about three or four driven rotating bodies 281 hold a part of the sheet 9 between the roller portion 272 and the driven rotating bodies 281. In each of the driven rotating units 28, about three or four driven rotating bodies 281 are rotatably supported by the single second shaft 282 which is hard.

About three or four driven rotating bodies 281 supported by the second shaft 282 move in substantially the same manner within a relatively large range in the first direction D1. Further, about three or four driven rotating bodies 281 press the sheet 9 toward the annular grooves 2721, respectively, so that the sheet 9 is curved to form a ridge line along the second direction D2. Thus, the sheet 9 is stably conveyed.

However, in the case where about three or four driven rotating bodies 281 supported by the single second shaft 282 are identical in outer diameter, a pressure similar to the pressure of the two first rotating bodies 281*a* is further applied by the second rotating body or bodies 281*b* to the portion of the sheet 9, to which portion a tension is applied by the contact with the first rotating bodies 281*a*. In this case, the second rotating body or bodies 281*b* may damage the sheet 9.

Actually, in the relay sheet conveying device 25, the outer diameter of the second rotating body 281*b* is smaller than the outer diameter of the first rotating body 281*a*. Thus, the second rotating body 281*b* does a reduced damage to the sheet 9.

In each of the driven rotating units 28, the plurality of driven rotating bodies 281 are independently rotatable with respect to the second shaft 282. Accordingly, either of the first rotating body 281*a* and the second rotating body 281*b* is prevented from rubbing against the first surface of the sheet 9 due to the difference in outer diameter.

In addition, in the relay sheet conveying device 25, the plurality of driven rotating bodies 281 are unitized in units of about three or four, and the second shaft 282 supports about three or four driven rotating bodies 281. Therefore, the relay sheet conveying device 25 is realized with a relatively small number of components.

What is claimed is:

1. A sheet conveying device comprising:

a conveying roller configured to convey a sheet having an image formed on a first surface of the sheet by discharged ink; and a plurality of driven rotating units, wherein the conveying roller includes:

a first shaft supported at a position along a first direction and driven to rotate; and a plurality of roller portions that are disposed at positions opposite to the plurality of driven rotating units, respectively, are fixed to the first shaft, and rotate in contact with a second surface of the sheet opposite with the first surface to convey the sheet in a second direction orthogonal to the first direction, wherein each of the plurality of roller portions has three or more annular grooves, wherein the three or more annular grooves are each provided over an entire circumference of each roller portion, and are arranged side by side in the first direction, wherein each of the plurality of driven rotating units includes:

a second shaft supported at a position along the first direction and urged toward the plurality of roller portions; and three or more driven rotating bodies disposed at positions opposite to the three or more annular grooves, respectively, and rotatably supported by the second shaft, wherein a plurality of convex portions and a plurality of concave portions are alternately provided over an entire circumference of an outer edge of each of the three or more driven rotating bodies, wherein each of the three or more driven rotating bodies is driven to rotate with respect to movement of the sheet by the plurality of convex portions coming into contact with the first surface of the sheet, and wherein the three or more driven rotating bodies in each driven rotating unit include:

two first rotating bodies positioned at both ends in the first direction; and one or more second rotating bodies located between the two first rotating bodies in the first direction and having an outer diameter smaller than the outer diameter of the two first rotating bodies.

2. The sheet conveying device according to claim 1, wherein, in each of the plurality of driven rotating units, the three or more driven rotating bodies are independently rotatable with respect to the second shaft.

3. The sheet conveying device according to claim 1, wherein the plurality of driven rotating units each include three or four driven rotating bodies.

4. An inkjet recording apparatus comprising:

the sheet conveying device according to claim 1; and an inkjet unit configured to discharge ink onto the sheet being conveyed to form an image on the sheet, wherein the sheet conveying device conveys the sheet, on which the image has been formed by the inkjet unit, downstream.

* * * * *